US009740126B2

(12) United States Patent
Iwase et al.

(10) Patent No.: US 9,740,126 B2
(45) Date of Patent: Aug. 22, 2017

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Masaki Iwase, Kanagawa (JP); Akira Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/205,759

(22) Filed: Jul. 8, 2016

(65) Prior Publication Data

US 2017/0199477 A1 Jul. 13, 2017

(30) Foreign Application Priority Data

Jan. 13, 2016 (JP) ..... 2016-004660

(51) Int. Cl.
*G03G 9/09* (2006.01)
*G03G 9/087* (2006.01)
*G03G 15/08* (2006.01)

(52) U.S. Cl.
CPC ..... *G03G 9/091* (2013.01); *G03G 9/08755* (2013.01); *G03G 9/08768* (2013.01); *G03G 15/0865* (2013.01)

(58) Field of Classification Search
CPC ..... G03G 9/091; G03G 9/08755
See application file for complete search history.

(56) References Cited

U.S. PATENT DOCUMENTS 6,117,606 A * 9/2000 Macholdt ..... C09D 5/035 106/31.81
2009/0123857 A1* 5/2009 Shu ..... G03G 9/091 430/107.1
2012/0251939 A1 10/2012 Tani et al.

FOREIGN PATENT DOCUMENTS

JP 2012-214724 A 11/2012
JP 2013-164619 A 8/2013

* cited by examiner

*Primary Examiner* — Peter Vajda
(74) *Attorney, Agent, or Firm* — Oliff PLC

(57) ABSTRACT

An electrostatic charge image developing toner includes a binder resin, C.I. Pigment Yellow 155, and toner particles containing at least one selected from dimethyl 2-aminoterephthalate and 1,4-bis(acetoacetylamino)benzene, wherein a total content of dimethyl 2-aminoterephthalate and 1,4-bis(acetoacetylamino)benzene in the toner particles is from 1 ppm to 500 ppm.

9 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-004660 filed Jan. 13, 2016.

BACKGROUND

1. Technical Field

The present invention relates to an electrostatic charge image developing toner, an electrostatic charge image developer, and a toner cartridge.

2. Related Art

In recent years, efforts have been actively made to apply an electrophotographic system for the light printing market, and image formation on a sheet of different kinds from conventional sheets has also been required. The thickness of the sheet to be used is varied depending on the kind of the sheet, and there may be some cases where on bending, a higher load is applied to an image. Accordingly, an improvement in the image strength is required.

SUMMARY

According to an aspect of the invention, there is provided an electrostatic charge image developing toner including:

a binder resin;

C.I. Pigment Yellow 155; and toner particles containing at least one selected from dimethyl 2-aminoterephthalate and 1,4-bis(acetoacetylamino)benzene, wherein a total content of dimethyl 2-aminoterephthalate and 1,4-bis(acetoacetylamino)benzene in the toner particles is from 1 ppm to 500 ppm.

BRIEF DESCRIPTION OF THE DRAWINGS

Exemplary embodiments of the present invention will be described in detail based on the following figures, wherein.

DETAILED DESCRIPTION

Figure 1:
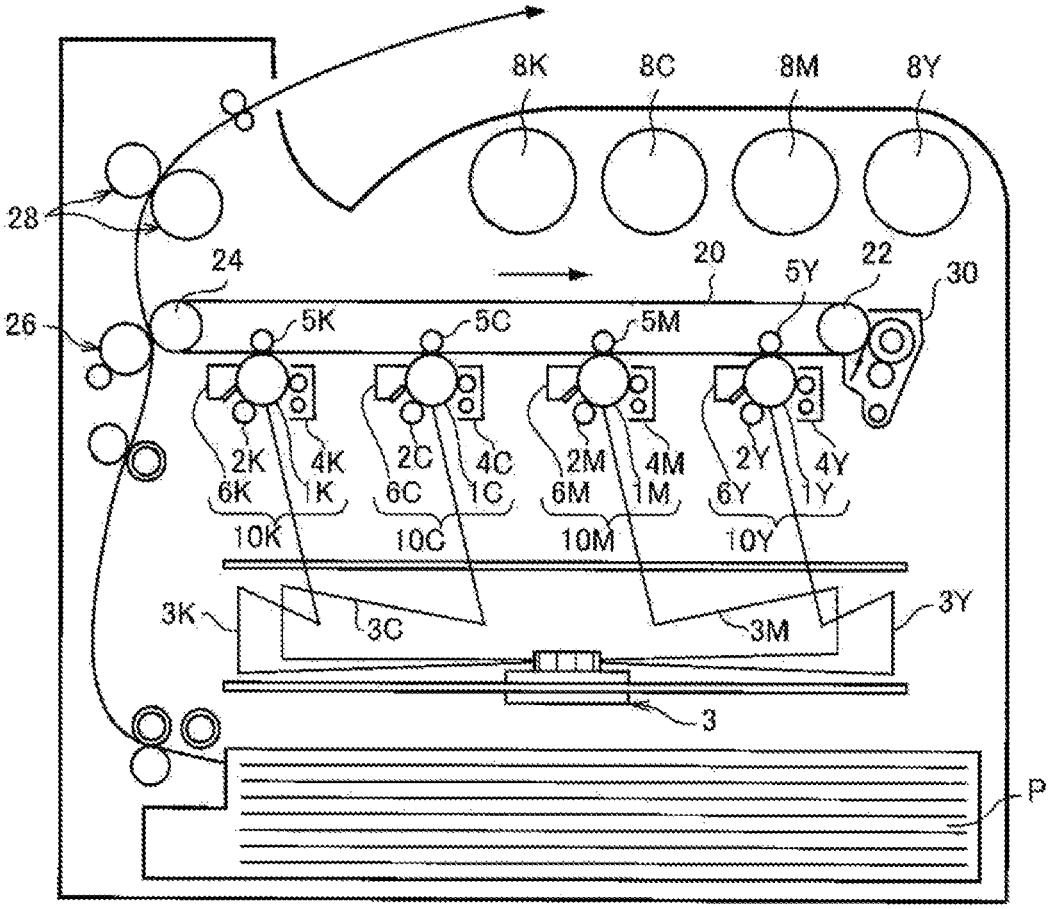
FIG. 1 is a configuration diagram of an example of an image forming apparatus according to an exemplary embodiment.

Hereinafter, exemplary embodiments which are an example of the invention will be described.

Electrostatic Charge Image Developing Toner

An electrostatic charge image developing toner according to an exemplary embodiment (hereinafter, the electrostatic charge image developing toner may be called "toner") contains toner particles containing at least one selected from a binder resin, C.I. Pigment Yellow 155, dimethyl 2-aminoterephthalate, and 1,4-bis(acetoacetylamino)benzene, and the total content of dimethyl 2-aminoterephthalate and 1,4-bis(acetoacetylamino)benzene is from 1 ppm to 500 ppm. In this description, the expression "ppm" is on a weight basis.

Hereinafter, dimethyl 2-aminoterephthalate and 1,4-bis(acetoacetylamino)benzene may be called "specific amino compound".

A toner image formed using the toner according to this exemplary embodiment has excellent bending characteristics (characteristics in which the image is difficult to peel even when a part where the image of the recording medium is formed is bent). The reason why the toner image formed using the toner according to this exemplary embodiment has excellent bending characteristics is not clear, but is presumed as follows.

A recording medium having an image formed thereon in an electrophotographic manner may be used after being bent after the formation of the image depending on the intended use. Examples of the intended use include a package (packaging material) which is formed by bending a recording medium such as thick paper after the formation of an image on the recording medium in an electrophotographic manner.

However, an image peeling phenomenon (deletion) may be caused in a place in which the bending has been performed, and particularly, in a half-tone image in which intervals between toner particles and other toner particles are easy to widen, the image peeling phenomenon is more easily caused. Therefore, a further improvement in the image strength with respect to the bending is required.

From results of the observation of a bent part of a toner image, the inventors have obtained knowledge that image defects are caused in an interface between an aggregated pigment and a binder resin in a case in which thick paper having a toner image formed thereon is bent. Accordingly, enhancing the dispersion of the pigment in the toner is considered to improve the image strength of the toner image.

The inventors have conducted intensive studies, and as a result, found that in a case in which C.I. Pigment Yellow 155 having the following structure is used as a colorant, an image which is difficult to peel even when being bent is formed by adding a predetermined amount of at least one (specific amino compound) selected from dimethyl 2-aminoterephthalate and 1,4-bis(acetoacetylamino)benzene to the toner.

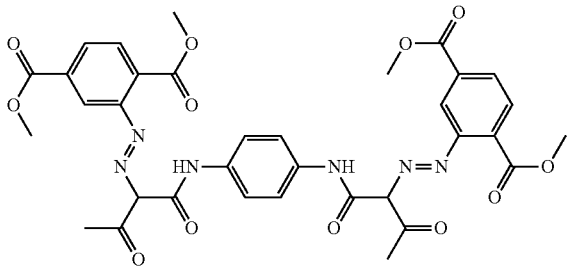

C.I. Pigment Yellow 155

Dimethyl 2-aminoterephthalate is a low-molecular-weight molecule having the following structure and high polarity. Therefore, for example, when using dimethyl 2-aminoterephthalate in preparing a toner through a wet preparation method, repulsion is made between molecules of dimethyl 2-aminoterephthalate, and thus the molecules are easy to more uniformly disperse in the toner.

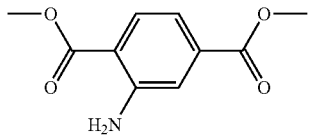

Dimethyl 2-aminoterephthalate

The structure of dimethyl 2-aminoterephthalate is similar to a part of the structure of C.I. Pigment Yellow 155. Therefore, C.I. Pigment Yellow 155 has a high affinity with dimethyl 2-aminoterephthalate, and C.I. Pigment Yellow 155 is easy to approach dimethyl 2-aminoterephthalate.

As a result, it is thought that when C.I. Pigment Yellow 155 approaches dimethyl 2-aminoterephthalate dispersed with high uniformity in the toner particles and is dispersed, the aggregation of C.I. Pigment Yellow 155 is prevented and a toner image having excellent bending characteristics is obtained.

1,4-bis(acetoacetylamino)benzene is a low-molecular-weight molecule having the following structure and high polarity, and repulsion is made between molecules thereof. Since the structure of 1,4-bis(acetoacetylamino)benzene is similar to a part of the structure of C.I. Pigment Yellow 155, C.I. Pigment Yellow 155 has a high affinity with 1,4-bis (acetoacetylamino)benzene. Therefore, it is thought that when C.I. Pigment Yellow 155 approaches 1,4-bis(acetoacetylamino)benzene dispersed with high uniformity in the toner and is dispersed, the aggregation of C.I. Pigment Yellow 155 is prevented and a toner image having excellent bending characteristics is obtained.

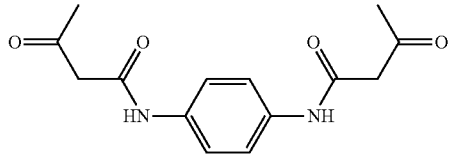

1,4-Bis(Acetoacetylamino)Benzene

As described above, regarding the toner according to this exemplary embodiment, it is presumed that since C.I. Pigment Yellow 155 is dispersed with high uniformity in the toner particles and the aggregation of the colorant (pigment) is thus prevented, image strength of a toner image is improved, and a toner image having excellent bending characteristics is formed.

Hereinafter, the toner according to this exemplary embodiment will be described in detail.

The toner according to this exemplary embodiment contains toner particles, and if necessary, an external additive.

Toner Particles

The toner particles contain, for example, a binder resin, C.I. Pigment Yellow 155, the above-described specific amino compound, and if necessary, a release agent and other additives.

C.I. Pigment Yellow 155

The toner particles contain C.I. Pigment Yellow 155 as a colorant. Here, "C.I." indicates colour index. Hereinafter, "C.I. Pigment Yellow" may be referred to as "pigment yellow".

The toner according to this exemplary embodiment may contain a colorant other than C.I. Pigment Yellow 155 in the toner particles. The content of all of the colorants (the content of all of the colorants including C.I. Pigment Yellow 155 and other colorants) is, for example, preferably from 1% by weight to 30% by weight, more preferably from 1% by weight to 20% by weight, and even more preferably from 3% by weight to 15% by weight with respect to the entire toner particles.

When the content of the colorants in the toner particles is 1% by weight or greater, a density required as a toner is imparted. When the content of the colorants in the toner particles is 30% by weight or less, the amount of the colorants which are present in a toner surface is prevented, and a reduction in charging properties is prevented.

In all of the colorants contained in the toner particles, C.I. Pigment Yellow 155 is preferably a main component (that is, it occupies 50% by weight or greater of all of the colorants). From the viewpoint of improving image strength with respect to the bending, C.I. Pigment Yellow 155 preferably occupies 60% by weight or greater, more preferably occupies 80% by weight or greater, and particularly preferably occupies 100% by weight in all of the colorants.

In this exemplary embodiment, the content of C.I. Pigment Yellow 155 is a value quantitatively determined by the following method.

Centrifugal separation is performed after dissolution of the toner in a solvent, and the content of C.I. Pigment Yellow 155 in the toner is obtained from the weight of precipitates. Specifically, 1 g of a toner is weighed, and tetrahydrofuran is added thereto to dissolve the toner. The tetrahydrofuran solution in which the toner is dissolved is centrifugally separated at 12,000 rpm for 10 minutes. Then, a supernatant liquid is removed and precipitates are dried. The weight of the precipitates is measured to calculate the content.

In the toner according to this exemplary embodiment, a weight ratio of the total content of the specific amino compound to the content of C.I. Pigment Yellow 155 (total content of specific amino compound/content of C.I. Pigment Yellow 155) is preferably from 0.00007% to 1%, more preferably from 0.0005% to 0.5%, and particularly preferably from 0.001% to 0.1% from the viewpoint of an improvement in transfer properties and bending characteristics of an image.

Other Colorants

Examples of other colorants include various pigments such as Carbon Black, Chrome Yellow, Hansa Yellow, Benzidine Yellow, Threne Yellow, Quinoline Yellow, Pigment Yellow (other than C.I. Pigment Yellow 155), Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

Other colorants may be used alone or in combination of two or more types thereof.

As other colorants, a colorant subjected to a surface treatment may be used if necessary, and may be used in combination with a dispersant. In addition, other colorants may be used in combination of plural types thereof.

Specific Amino Compound

The toner according to this exemplary embodiment contains a specific amino compound, that is, at least one of dimethyl 2-aminoterephthalate and 1,4-bis(acetoacetylamino)benzene in the toner particles, the total content of the specific amino compound is from 1 ppm to 500 ppm.

When the content of the specific amino compound in the toner particles is less than 1 ppm, dispersibility of C.I. Pigment Yellow 155 is not improved, and the image strength with respect to the bending is not obtained. When the content of the specific amino compound in the toner particles is greater than 500 ppm, charge leakage properties of the toner increase, and image transfer performance is reduced.

From such a viewpoint, the total content of the specific amino compound in the toner particles is preferably from 100 ppm to 400 ppm, and more preferably from 200 rpm to 300 rpm. In this description, the expression "ppm" indicating the content of the specific amino compound is on a weight basis.

The toner according to this exemplary embodiment preferably contains dimethyl 2-aminoterephthalate as the specific amino compound in the toner particles from the viewpoint of improving dispersibility of C.I. Pigment Yellow 155.

The content of the specific amino compound in the toner particles is obtained using a calibration curve measured in advance by liquid chromatography (LC-UV). Specifically, 0.05 g of a toner is weighed, and tetrahydrofuran is added thereto. Thereafter, the obtained material is subjected to ultrasonic extraction for 30 minutes. An extraction liquid is then collected, and the liquid of which the amount is accurately adjusted to 20 mL with acetonitrile is used as a test solution and is subjected to the measurement by liquid chromatography (LC-UV). The toner particles are subjected to the measurement in a state in which an external additive and the like are not added, that is, without addition of an external additive. However, in the case of a structure in which inorganic or organic fine particles such as an external additive adhere to surfaces of the toner particles, the toner is dispersed using a surfactant or the like in a medium such as water which does not dissolve the toner to perform an ultrasonic treatment, the fine particles are liberated from the toner structure and removed in advance from the toner by filtering or centrifugal separation, the medium is also removed for drying, and then the evaluation is performed. Fine particles which are not separated from the toner through this operation are removed as insoluble portion by centrifugal separation or the like after dissolution of the toner in tetrahydrofuran or the like in which the toner is soluble. At that time, only the insoluble portion is removed such that the toner dissolution component is not eliminated. Then, concentration is performed, and the evaluation is performed using the concentrated compound as a toner component.

Binder Resin

Examples of the binder resin include vinyl resins formed of homopolymers of monomers such as styrenes (e.g., styrene, parachlorostyrene, and α-methyl styrene), (meth) acrylic esters (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (e.g., acrylonitrile and methacrylonitrile), vinyl ethers (e.g., vinyl methyl ether and vinyl isobutyl ethyer), vinyl ketones (vinyl methyl ketone, vinyl ethyl ketone, and vinyl isopropenyl ketone), and olefins (e.g., ethylene, propylene, and butadiene), or copolymers obtained by combining two or more types of these monomers.

As the binder resin, there are also exemplified non-vinyl resins such as epoxy resins, polyester resins, polyurethane resins, polyamide resins, cellulose resins, polyether resins, and modified rosin, mixtures thereof with the above-described vinyl resins, or graft polymers obtained by polymerizing a vinyl monomer with the coexistence of such non-vinyl resins.

These binder resins may be used alone or in combination of two or more types thereof.

A polyester resin is suitable as the binder resin.

Examples of the polyester resin include known polyester resins.

Examples of the polyester resin include a condensation polymer of a polyvalent carboxylic acid and a polyol. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalene dicarboxylic acid), anhydrides thereof, and lower alkyl esters (having, for example, from 1 to 5 carbon atoms) thereof. Among these, for example, aromatic dicarboxylic acids are preferable as the polyvalent carboxylic acid.

The polyvalent carboxylic acid may be used in combination with a tri- or higher-valent carboxylic acid employing a crosslinked structure or a branched structure, together with a dicarboxylic acid. Examples of the tri- or higher-valent carboxylic acid include trimellitic acid, pyromellitic acid, anhydrides thereof, and lower alkyl esters (having, for example, from 1 to 5 carbon atoms) thereof.

The polyvalent carboxylic acids may be used alone or in combination of two or more types thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferable, and aromatic diols are more preferable as the polyol.

The polyol may be used in combination with a tri- or higher-valent polyol employing a crosslinked structure or a branched structure, together with a dial. Examples of the tri- or higher-valent polyol include glycerin, trimethylolpropane, and pentaerythritol.

The polyols may be used alone or in combination of two or more types thereof.

A glass transition temperature (Tg) of the polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from the "extrapolated glass transition onset temperature" described in the method of obtaining a glass transition temperature in the "testing methods for transition temperatures of plastics" in JIS K 7121-1987.

A weight average molecular weight (Mw) of the polyester resin is preferably from 5,000 to 1,000,000, and more preferably from 7,000 to 500,000.

A number average molecular weight (Mn) of the polyester resin is preferably from 2,000 to 100,000.

A molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed using a GPC•HLC-8120 GPC manufactured by Tosoh Corporation as a measuring device, a TSKgel Super HM-M (15 cm) which is a column manufactured by Tosoh Corporation, and a THF solvent. The weight average molecular weight and the number average molecular weight are calculated using a molecular weight calibration curve plotted from a monodisperse polystyrene standard sample from the results of the above measurement.

A known preparation method is used to prepare the polyester resin. Specific examples thereof include a method of conducting a reaction at a polymerization temperature set to from 180° C. to 230° C. under reduced pressure if necessary in the reaction system, while removing water or an alcohol that is generated during condensation.

When monomers of the raw materials are not dissolved or compatibilized at a reaction temperature, a high-boiling-point solvent may be added as a solubilizing agent to dissolve the monomers. In this case, a polycondensation reaction is caused while distilling away the solubilizing agent. When a monomer having poor compatibility is present in a copolymerization reaction, the monomer having poor compatibility and an acid or an alcohol to be polycondensed with the monomer may be preliminarily condensed, and then polycondensed with the major component.

Here, as the polyester resin, a modified polyester resin is also exemplified other than the above-described unmodified polyester resin. The modified polyester resin is a polyester resin in which a polyester resin having a bonding group other than an ester bond and a resin component which is different from the polyester resin component are bonded via a covalent bond or an ionic bond. Examples of the modified polyester include a resin having an end modified by the reaction of an active hydrogen compound with a polyester resin in which a functional group such as an isocyanate group which reacts with an acid group or a hydroxyl group is introduced to an end.

As the modified polyester resin, a urea-modified polyester resin is particularly preferable. The content of the urea-modified polyester resin is preferably from 10% by weight to 30% by weight, and more preferably from 15% by weight to 25% by weight with respect to the entire binder resin.

The urea-modified polyester resin is preferably obtained by the reaction (at least one of a crosslinking reaction and an elongation reaction) of a polyester resin (polyester prepolymer) having an isocyanate group and an amine compound. The urea-modified polyester resin may contain a urethane bond together with the urea bond.

Examples of the polyester prepolymer having an isocyanate group include a prepolymer which is obtained by the reaction of a polyvalent isocyanate compound with a polyester which is a polycondensate of a polyvalent carboxylic acid and a polyol and has active hydrogen. Examples of the group having active hydrogen of the polyester include a hydroxyl group (alcoholic hydroxyl group and phenolic hydroxyl group), an amino group, a carboxyl group, and a mercapto group. An alcoholic hydroxyl group is preferable.

In the polyester prepolymer having an isocyanate group, as the polyvalent carboxylic acid and the polyol, compounds similar to the polyvalent carboxylic acid and the polyol in the description of the polyester resin are exemplified.

Examples of the polyvalent isocyanate compound include aliphatic polyisocyanates (tetramethylene diisocyanate, hexamethylene diisocyanate, 2,6-diisocyanate methylcaproate, and the like); alicyclic polyisocyanates (isophorone diisocyanate, cyclohexylmethane diisocyanate, and the like); aromatic diisocyanates (tolylene diisocyanate, diphenylmethane diisocyanate, and the like); aromatic aliphatic diisocyanates ($\alpha,\alpha,\alpha',\alpha'$-tetramethyl xylylene diisocyanate and the like); isocyanurates; and blocked polyisocyanates in which the above-described polyisocyanates are blocked with a blocking agent such as a phenol derivative, oxime, or caprolactam.

The polyvalent isocyanate compounds may be used alone or in combination of two or more types thereof.

Regarding the proportion of the polyvalent isocyanate compound, an equivalent ratio ([NCO]/[OH]) of the isocyanate group [NCO] to the hydroxyl group [OH] of the polyester prepolymer having a hydroxyl group is preferably from 1/1 to 5/1, more preferably from 1.2/1 to 4/1, and even more preferably from 1.5/1 to 2.5/1. When [NCO]/[OH] is 5 or less, a reduction in low-temperature fixability is easily prevented.

The content of the component derived from the polyvalent isocyanate compound in the polyester prepolymer having an isocyanate group is preferably from 0.5% by weight to 40% by weight, more preferably from 1% by weight to 30% by weight, and even more preferably from 2% by weight to 20% by weight with respect to the entire polyester prepolymers having an isocyanate group. When the content of the component derived from the polyvalent isocyanate is 40% by weight or less, a reduction in low-temperature fixability is easily prevented.

The number of isocyanate groups contained in a molecule of the polyester prepolymer having an isocyanate group is preferably 1 or more on average, more preferably from 1.5 to 3 on average, and even more preferably from 1.8 to 2.5 on average. When the number of isocyanate groups is 1 or more in a molecule, the molecular weight of the urea-modified polyester resin after the reaction increases.

Examples of the amine compound which reacts with the polyester prepolymer having an isocyanate group include diamine, tri- or higher-valent polyamine, amino alcohol, amino mercaptan, amino acid, and compounds in which the amino group of these amines is blocked.

Examples of the diamine include aromatic diamines (phenylene diamine, diethyltoluene diamine, 4,4'-diaminodiphenyl methane, and the like); alicyclic diamines (4, 4'-diamino-3,3'-dimethyldicyclohexyl methane, diaminecyclohexane, isophorone diamine, and the like); and aliphatic diamines (ethylene diamine, tetramethylene diamine, hexamethylene diamine, and the like).

Examples of the tri- or higher-valent polyamine include diethylene triamine and triethylene tetramine.

Examples of the amino alcohol include ethanol amine and hydroxyethylaniline.

Examples of the amino mercaptan include aminoethyl mercaptan and aminopropyl mercaptan.

Examples of the amino acid include amino propionic acid and amino caproic acid.

Examples of the compounds in which the amino group of these amines is blocked include ketimine compounds obtained from amine compounds such as diamine, tri- or higher-valent polyamine, amino alcohol, amino mercaptan, and amino acid and ketone compounds (acetone, methyl ethyl ketone, methyl isobutyl ketone, and the like), and oxazoline compounds.

Among these amine compounds, ketimine compounds are preferable.

The amine compounds may be used alone or in combination of two or more types thereof.

The urea-modified polyester resin may be a resin in which the molecular weight after the reaction is adjusted by adjusting a reaction (at least one of a crosslinking reaction and an elongation reaction) of a polyester resin (polyester prepolymer) having an isocyanate group and an amine compound with a stopping agent (hereinafter, also referred to as "crosslinking/elongation reaction stopping agent") which stops at least one of the crosslinking reaction and the elongation reaction.

Examples of the crosslinking/elongation reaction stopping agent include monoamines (diethyl amine, dibutyl amine, butyl amine, lauryl amine, and the like) and blocked amines (ketimine compounds) prepared by blocking the monoamines.

Regarding the proportion of the amine compound, an equivalent ratio ([NCO]/[NHx]) of the isocyanate group [NCO] in the polyester prepolymer having an isocyanate group to the amino group [NHx] in the amines is preferably from 1/2 to 2/1, more preferably from 1/1.5 to 1.5/1, and even more preferably from 1/1.2 to 1.2/1. When [NCO]/[NHx] is within the above range, the molecular weight of the urea-modified polyester resin after the reaction increases.

The glass transition temperature of the urea-modified polyester resin is preferably from 40° C. to 65[° C.], and more preferably from 45° C. to 60° C. The number average molecular weight is preferably from 2,500 to 50,000, and more preferably from 2,500 to 30,000. The weight average molecular weight is preferably from 10,000 to 500,000, and more preferably from 30,000 to 100,000.

The content of the binder resin is, for example, preferably from 40% by weight to 95% by weight, more preferably from 50% by weight to 90% by weight, and even more preferably from 60% by weight to 85% by weight with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from the "melting peak temperature" described in the method of obtaining a melting temperature in the "testing methods for transition temperatures of plastics" in JIS K 7121-1987, from a DSC curve obtained by differential scanning calorimetry (DSC).

The content of the release agent is, for example, preferably from 1% by weight to 20% by weight, and more preferably from 5% by weight to 15% by weight with respect to the entire toner particles.

Other Additives

Examples of other additives include known additives such as a magnetic material, a charge-controlling agent, and an inorganic powder. The toner particles contain these additives as internal additives.

Characteristics of Toner Particles

The toner particles may have a single layer structure or a so-called core-shell structure composed of a core (core particle) and a coating layer (shell layer) that is coated on the core.

Here, toner particles having a core-shell structure are preferably composed of, for example, a core configured to contain a binder resin, a colorant, a specific amino compound, and if necessary, other additives such as a release agent, and a coating layer configured to contain a binder resin.

The volume average particle diameter (D50v) of the toner particles is preferably from 2 μm to 10 μm, and more preferably from 4 μm to 8 μm.

Various average particle diameters and various particle diameter distribution indices of the toner particles are measured using a COULTER MULTISIZER II (manufactured by Beckman Coulter, Inc.) with ISOTON-II (manufactured by Beckman Coulter, Inc.) as an electrolyte.

In the measurement, from 0.5 mg to 50 mg of a measurement sample is added to 2 ml of an aqueous solution of 5% surfactant (preferably sodium alkylbenzene sulfonate) as a dispersant. The obtained material is added to from 100 ml to 150 ml of an electrolyte.

The electrolyte in which the sample is suspended is subjected to a dispersion treatment using an ultrasonic disperser for 1 minute, and a particle diameter distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a cumulative number average particle diameter D50p. Furthermore, the particle diameter when the cumulative percentage becomes 84% is defined as that corresponding to a volume particle diameter D84v and a number particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

A shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression:}$$

In the above expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles applied to a surface of a slide glass is input to an image analyzer LUZEX through a video camera to obtain maximum lengths and projected areas of 100 particles, values of SF1 are calculated using the above expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles used as an external additive are preferably subjected to a hydrophobizing treatment. The hydrophobizing treatment is performed by, for example, dipping the inorganic particles in a hydrophobizing agent. The hydrophobizing agent is not particularly limited, and examples thereof include silane coupling agents, silicone oil, titanate coupling agents, and aluminum coupling agents. These may be used alone or in combination of two or more types thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethylmethacrylate (PMMA), and melamine resin) and a cleaning aid (e.g., metal salt of higher fatty acid represented by zinc stearate, and fluorine polymer particles).

The amount of the external additive to be externally added is, for example, preferably from 0.01% by weight to 5% by weight, and more preferably from 0.01% by weight to 2.0% by weight with respect to the toner particles.

Toner Preparation Method

Next, a toner preparation method according to this exemplary embodiment will be described.

The toner according to the exemplary embodiment is obtained by externally adding an external additive to toner particles after preparation of the toner particles.

The toner particles may be prepared by any of a dry method (e.g., kneading and pulverizing method) and a wet method (e.g., aggregation and coalescence method, suspension and polymerization method, and dissolution and suspension method). The toner particle preparation method is not particularly limited to these methods, and a known preparation method is employed.

Among these, the toner particles are preferably obtained by an aggregation and coalescence method.

Aggregation and Coalescence Method

Specifically, for example, in a case in which the toner particles are prepared by an aggregation and coalescence method, the toner particles are prepared through the steps of: preparing a resin particle dispersion in which resin particles as a binder resin are dispersed (resin particle dispersion preparation step), aggregating the resin particles (if necessary, other particles) in the resin particle dispersion (if necessary, in the dispersion after mixing with other particle dispersions) to form aggregated particles (aggregated particle forming step), and heating the aggregated particle dispersion in which the aggregated particles are dispersed, to coalesce the aggregated particles, thereby forming toner particles (coalescence step).

Hereinafter, the steps will be described in detail.

In the following description, a method of obtaining toner particles containing a colorant and a release agent will be described. However, the release agent is used if necessary. Additives other than the colorant and the release agent may also be used.

Resin Particle Dispersion Preparation Step

First, for example, a colorant particle dispersion in which colorant particles containing at least C.I. Pigment Yellow 155 are dispersed and a release agent particle dispersion in which release agent particles are dispersed are prepared together with a resin particle dispersion in which resin particles as a binder resin are dispersed.

Here, the resin particle dispersion is prepared by, for example, dispersing resin particles with a surfactant in a dispersion medium.

Examples of the dispersion medium which is used for the resin particle dispersion include aqueous mediums.

Examples of the aqueous mediums include water such as distilled water and ion exchange water, and alcohols. These may be used alone or in combination of two or more types thereof.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol nonionic surfactants. Among these, anionic surfactants and cationic surfactants are particularly preferable. Nonionic surfactants may be used in combination with anionic surfactants or cationic surfactants.

The surfactants may be used alone or in combination of two or more types thereof.

Regarding the resin particle dispersion, as a method of dispersing the resin particles in the dispersion medium, for example, common dispersing methods using, for example, a rotary shearing-type homogenizer, and a ball mill, a sand mill, and a Dyno mill, each having media, are exemplified. Depending on the type of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding abase to an organic continuous phase (O phase); converting the resin (so-called phase inversion) from W/O to O/W by adding an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement with a laser diffraction-type particle diameter distribution measuring device (for example, manufactured by Horiba, Ltd. LA-700), and the particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Step

Next, the colorant particle dispersion and the release agent particle dispersion are mixed together with the resin particle dispersion.

The addition of a specific amino compound is not particularly limited. The specific amino compound is preferably added when the above-described dispersions are mixed. The amount to be added is preferably adjusted such that the content of the specific amino compound in the toner particles is within the above-described range.

The resin particles, the colorant particles, the release agent particles, and the specific amino compound are heterogeneously aggregated in the mixed dispersion to form aggregated particles with a diameter near a target toner particle diameter that include the resin particles, the colorant particles, the release agent particles, and the specific amino compound.

Specifically, for example, an aggregating agent is added to the mixed dispersion and a pH of the mixed dispersion is adjusted to acidic (for example, the pH is from 2 to 5). If necessary, a dispersion stabilizer is added. Then, the mixed dispersion is heated at a glass transition temperature of the resin particles (specifically, for example, from a temperature lower than the glass transition temperature of the resin particles by 30° C. to a temperature lower than the glass transition temperature by 10° C.) to aggregate the particles dispersed in the mixed dispersion, thereby forming the aggregated particles.

In the aggregated particle forming step, for example, the aggregating agent may be added at room temperature (for example, 25° C.) under stirring of the mixed dispersion using a rotary shearing-type homogenizer, the pH of the mixed dispersion may be adjusted to acidic (for example, the pH is from 2 to 5), a dispersion stabilizer may be added if necessary, and the heating may be then performed.

Examples of the aggregating agent include a surfactant having a polarity opposite to that of the surfactant which is used as the dispersant to be added to the mixed dispersion, such as inorganic metal salts and di- or higher-valent metal complexes. Particularly, in a case in which a metal complex is used as the aggregating agent, the amount of the surfactant to be used is reduced and charging characteristics are improved.

If necessary, an additive may be used which forms a complex or a similar bond with the metal ions of the aggregating agent. As this additive, a chelating agent is preferably used.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent to be added is, for example, preferably from 0.01 parts by weight to 5.0 parts by weight, and more preferably from 0.1 parts by weight to less than 3.0 parts by weight with respect to 100 parts by weight of the resin particles.

Coalescence Step

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by from 10° C. to 30° C.) to coalesce the aggregated particles and form toner particles.

Toner particles are obtained through the above steps.

After the aggregated particle dispersion in which the aggregated particles are dispersed is obtained, toner particles may be prepared through the steps of: further mixing the aggregated particle dispersion and the resin particle dispersion in which the resin particles are dispersed to conduct aggregation such that the resin particles further adhere to the surfaces of the aggregated particles, thereby forming second aggregated particles; and coalescing the second aggregated particles by heating a second aggregated particle dispersion in which the second aggregated particles are dispersed, thereby forming toner particles having a core-shell structure.

Here, after the coalescence step ends, the toner particles formed in the solution are subjected to a washing step, a solid-liquid separation step, and a drying step, that are well known, and thus dry toner particles are obtained.

In the washing step, sufficient displacement washing with ion exchange water is preferably performed from the viewpoint of charging properties. In addition, the solid-liquid separation step is not particularly limited, but suction filtration, pressure filtration, or the like is preferably performed from the viewpoint of productivity. Furthermore, the method for the drying step is also not particularly limited, but freeze drying, flash jet drying, fluidized drying, vibration-type fluidized drying, or the like is preferably performed from the viewpoint of productivity.

Dissolution and Suspension Method

In a case in which toner particles containing a urea-modified polyester resin as a binder resin are prepared, the toner particles are preferably obtained through a dissolution and suspension method (also referred to as an ester elongation polymerization method) which will be shown below. In the following description of the dissolution and suspension method, a method of obtaining toner particles containing a release agent will be shown. However, the release agent is contained in the toner particles if necessary. In addition, a method of obtaining toner particles containing an unmodified polyester resin and a urea-modified polyester resin as a binder resin will be shown. However, the toner particles may contain only the urea-modified polyester resin as a binder resin.

Oil Phase Liquid Preparation Step

An oil phase liquid in which toner particle materials including an unmodified polyester resin, a polyester prepolymer having an isocyanate group, an amine compound (except for specific amino compound), a colorant containing at least C.I. Pigment Yellow 155, a specific amino compound, and a release agent are dissolved or dispersed in an organic solvent is prepared (oil phase liquid preparation step). This oil phase liquid preparation step is a step of obtaining a mixed liquid of toner materials by dissolving or dispersing toner particle materials in an organic solvent.

Examples of the method of preparing the oil phase liquid include 1) a preparation method including: collectively dissolving or dispersing toner materials in an organic solvent, 2) a preparation method including: kneading toner materials in advance; and dissolving or dispersing the kneaded material in an organic solvent, 3) a preparation method including: dissolving and reacting an unmodified polyester resin, a polyester prepolymer having an isocyanate group, and an amine compound in an organic solvent; and dispersing a colorant containing C.I. Pigment Yellow 155, a specific amino compound, and a release agent in the organic solvent, and 4) a preparation method including: dispersing a release agent in an organic solvent; dissolving and reacting an unmodified polyester resin, a polyester prepolymer having an isocyanate group, and an amine compound in the organic solvent; and dissolving a colorant containing C.I. Pigment Yellow 155 and a specific amino compound. The oil phase liquid preparation method is not limited thereto.

Examples of the organic solvent of the oil phase liquid include ester solvents such as methyl acetate and ethyl acetate; ketone solvents such as methyl ethyl ketone and methyl isopropyl ketone; aliphatic hydrocarbon solvents such as hexane and cyclohexane; and halogenated hydrocarbon solvents such as dichloromethane, chloroform, and trichloroethylene. These organic solvents dissolve the binder resin. The dissolution ratio thereof in water is approximately from 0% by weight to 30% by weight, and the boiling point thereof is preferably 100° C. or lower. Among these organic solvents, ethyl acetate is preferable.

Suspension Preparation Step

Next, a suspension is prepared by dispersing the obtained oil phase liquid in an aqueous phase liquid (suspension preparation step).

The polyester prepolymer having an isocyanate group and the amine compound are reacted together with the preparation of the suspension. A urea-modified polyester resin is formed through this reaction. This reaction is associated with at least one of a crosslinking reaction and an elongation reaction of molecular chains. The reaction between the polyester prepolymer having an isocyanate group and the amine compound a may be caused together with an organic solvent removal step to be described later.

Here, the reaction conditions are selected according to an isocyanate group structure of the polyester prepolymer and reactivity with the amine compound. For example, the reaction time is preferably from 10 minutes to 40 hours, and more preferably from 2 hours to 24 hours. The reaction temperature is preferably from 0° C. to 150° C., and more preferably from 40° C. to 98° C. For the formation of the urea-modified polyester resin, a known catalyst (dibutyltin laurate, dioctyltin laurate, or the like) may be used if necessary. That is, a catalyst may be added to the oil phase liquid or the suspension.

As the aqueous phase liquid, an aqueous phase liquid in which a particle dispersant such as an organic particle dispersant or an inorganic particle dispersant is dispersed in an aqueous solvent is exemplified. As the aqueous phase liquid, an aqueous phase liquid in which a polymer dispersant is dissolved in an aqueous solvent with the dispersion of a particle dispersant in the aqueous solvent is also exemplified. A known additive such as a surfactant may be added to the aqueous phase liquid.

Examples of the aqueous solvent include water (e.g., generally, ion exchange water, distilled water, and pure water). The aqueous solvent may contain, in addition to water, an organic solvent such as alcohols (methanol, isopropyl alcohol, ethylene glycol, and the like), dimethylformamide, tetrahydrofuran, cellosolves (methyl cellosolve and the like), and lower ketones (acetone, methyl ethyl ketone, and the like).

Hydrophilic organic particle dispersants are exemplified as the organic particle dispersant. Examples of the organic particle dispersant include particles of alkyl poly(meth) acrylate resins (e.g., methyl polymethacrylate), polystyrene resins, and poly(styrene-acrylonitrile) resins. Examples of the organic particle dispersant also include particles of styrene acrylic resins.

Hydrophilic inorganic particle dispersants are exemplified as the inorganic particle dispersant. Specific examples of the inorganic particle dispersant include particles of silica, alumina, titania, calcium carbonate, magnesium carbonate, tricalcium phosphate, clay, diatomaceous earth, and bentonite, and particles of calcium carbonate are preferable. The inorganic particle dispersants may be used alone or in combination of two or more types thereof.

The particle dispersant may be subjected to a surface treatment with a polymer having a carboxyl group.

As the polymer having a carboxyl group, copolymers of an α,β-monoethylenic unsaturated carboxylic ester and at least one selected from salts (alkali metal salt, alkaline-earth metal salt, ammonium salt, amine salt, and the like) obtained by neutralizing an α,β-monoethylenic unsaturated carboxylic acid or a carboxyl group of an α,β-monoethylenic unsaturated carboxylic acid by alkali metal, alkaline-earth metal, ammonium, amine, and the like are exemplified. As the polymer having a carboxyl group, salts (alkali metal salt, alkaline-earth metal salt, ammonium salt, amine salt, and the like) obtained by neutralizing the carboxyl group of a copolymer of an α,β-monoethylenic unsaturated carboxylic acid and an α,β-monoethylenic unsaturated carboxylic ester by alkali metal, alkaline-earth metal, ammonium, amine, and the like are also exemplified. The polymers having a carboxyl group may be used alone or in combination of two or more types thereof.

Representative examples of the α,β-monoethylenic unsaturated carboxylic acid include α,β-unsaturated monocarboxylic acids (acrylic acid, methacrylic acid, crotonic acid, and the like) and α,β-unsaturated dicarboxylic acids (maleic acid, fumaric acid, itaconic acid, and the like). Representative examples of the α,β-monoethylenic unsaturated carboxylic acid ester include alkyl esters of (meth) acrylic acids, (meth)acrylates having an alkoxy group, (meth)acrylates having a cyclohexyl group, (meth)acrylates having a hydroxy group, and polyalkylene glycol mono (meth)acrylates.

Hydrophilic polymer dispersants are exemplified as the polymer dispersant. Specific examples of the polymer dispersant include polymer dispersants having a carboxyl group, but not having a lipophilic group (hydroxypropoxy group, methoxy group, and the like) (water-soluble cellulose ethers such as carboxymethyl cellulose and carboxyethyl cellulose).

Solvent Removal Step

Next, a toner particle dispersion is obtained by removing the organic solvent from the obtained suspension (solvent removal step). In this solvent removal step, the organic solvent contained in droplets of the aqueous phase liquid dispersed in the suspension is removed to obtain toner particles. The removal of the organic solvent from the suspension may be performed immediately after the suspension preparation step. The organic solvent may be removed after 1 minute or longer from the end of the suspension preparation step.

In the solvent removal step, the organic solvent may be removed from the suspension by cooling or heating the obtained suspension at a temperature of from 0° C. to 100° C.

Specific methods of removing the organic solvent are as follows.

(1) A method of forcibly updating a gas phase on the liquid surface of the suspension by blowing an air flow to the suspension. In this case, a gas may be blown into the suspension.

(2) A method of reducing the pressure. In this case, a gas phase on the liquid surface of the suspension may be forcibly renewed by gas filling, or a gas may be blown into the suspension.

Toner particles are obtained through the above steps.

Here, after the solvent removal step ends, the toner particles formed in the toner particle dispersion are subjected to a washing step, a solid-liquid separation step, and a drying step, that are well known, and thus dry toner particles are obtained.

In the washing step, sufficient displacement washing with ion exchange water is preferably performed from the viewpoint of charging properties.

The solid-liquid separation step is not particularly limited, but suction filtration, pressure filtration, or the like is preferably performed from the viewpoint of productivity. Furthermore, the method for the drying step is also not particularly limited, but freeze drying, flash jet drying, fluidized drying, vibration-type fluidized drying, or the like are preferably performed from the viewpoint of productivity.

The toner according to this exemplary embodiment is prepared by, for example, adding an external additive to dry toner particles that have been obtained, and mixing them. The mixing is preferably performed with, for example, a V-blender, a HENSCHEL mixer, a LÖEDIGE mixer, or the like. Furthermore, if necessary, coarse toner particles may be removed using a vibrating sieving machine, a wind classifier, or the like.

Image Forming Apparatus and Image Forming Method

An image forming apparatus and an image forming method according to this exemplary embodiment will be described.

The image forming apparatus according to this exemplary embodiment is provided with an image holding member, a charging unit which charges a surface of the image holding member, an electrostatic charge image forming unit which forms an electrostatic charge image on the charged surface of the image holding member, a developing unit which contains an electrostatic charge image developer and develops the electrostatic charge image formed on the surface of the image holding member with the electrostatic charge image developer to form a toner image, a transfer unit which transfers the toner image formed on the surface of the image holding member onto a surface of a recording medium, and a fixing unit which fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including the steps of: charging a surface of an image holding member; forming an electrostatic charge image on the charged surface of the image holding member; developing the electrostatic charge image formed on the surface of the image holding member with the electrostatic charge image developer according to this exemplary embodiment to form a toner image; transferring the toner image formed on the surface of the image holding member onto a surface of a recording medium; and fixing the toner image transferred onto the surface of the recording medium is performed.

As the image forming apparatus according to this exemplary embodiment, a known image forming apparatus is applied, such as a direct transfer-type apparatus which directly transfers a toner image formed on a surface of an image holding member onto a recording medium; an intermediate transfer-type apparatus which primarily transfers a toner image formed on a surface of an image holding member onto a surface of an intermediate transfer member, and secondarily transfers the toner image transferred onto the surface of the intermediate transfer member onto a surface of a recording medium; an apparatus which is provided with a cleaning unit which cleans a surface of an image holding member before charging after transfer of a toner image; or an apparatus which is provided with an erasing unit which irradiates a surface of an image holding member with erasing light after transfer of a toner image and before charging.

In the case of an intermediate transfer-type apparatus, a transfer unit is configured to have, for example, an intermediate transfer member having a surface onto which a toner image is to be transferred, a primary transfer unit which primarily transfers a toner image formed on a surface of an image holding member onto the surface of the intermediate transfer member, and a secondary transfer unit which secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) which is detachable from the image forming apparatus. As the process cartridge, for example, a process cartridge provided with a developing unit containing the electrostatic charge image developer according to this exemplary embodiment is preferably used.

Hereinafter, an example of the image forming apparatus according to this exemplary embodiment will be shown. However, the image forming apparatus is not limited thereto. Major parts shown in the drawing will be described, but descriptions of other parts will be omitted.

FIG. 1 is a configuration diagram of an image forming apparatus according to this exemplary embodiment.

The image forming apparatus illustrated in FIG. 1 is provided with first to fourth electrophotographic image forming units 10Y, 10M, 10C, and 10K (image forming units) which output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges which are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toners including four color toners, that is, a yellow toner, a magenta toner, a cyan toner, and a black toner contained in toner cartridges 8Y, 8M, 8C, and 8K, respectively. The toner cartridge 8Y contains the toner according to this exemplary embodiment.

The first to fourth units 10Y, 10M, 10C, and 10K have the same configuration. Here, the first unit 10Y which is disposed on the upstream side in a traveling direction of the intermediate transfer belt to form a yellow image will be representatively described. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y which charges a surface of the photoreceptor 1Y to a predetermined potential, an exposure device (an example of the electrostatic charge image forming unit) 3 which exposes the charged surface with laser beams 3Y based on a color-separated image signal to form an electrostatic charge image, a developing device (an example of the developing unit) 4Y which supplies a charged toner to the electrostatic charge image to develop the electrostatic charge image, a primary transfer roll (an example of the primary transfer unit) 5Y which transfers the developed toner image onto the intermediate transfer belt 20, and a photoreceptor cleaning device (an example of the cleaning unit) 6Y which removes the toner remaining on the surface of the photoreceptor 1Y after primary transfer, are arranged in sequence.

The primary transfer roll 5Y is disposed inside the intermediate transfer belt 20 so as to be provided at a position opposed to the photoreceptor 1Y. Furthermore, bias supplies (not shown) which apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of from −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image formed on the surface of the photoreceptor 1Y by charging, and is a so-called negative latent image, that is formed by applying the laser beams 3Y to the photosensitive layer such that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y contains, for example, an electrostatic charge image developer containing at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner is electrostatically adhered to an erased latent image part on the surface of the photoreceptor 1Y, whereby the latent image is developed with the yellow toner. Next, the photoreceptor 1Y having the yellow toner image formed thereon travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y, an electrostatic force toward the primary transfer roll 5Y from the photoreceptor 1Y acts on the toner image, and the toner image on the photoreceptor 1Y is transferred onto the intermediate transfer belt 20. The transfer bias applied at this time has the opposite polarity (+) of the toner polarity (−), and is controlled to +10 μA by the controller (not shown) in the first unit 10Y.

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image has been transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is transported to a pressure-contacting part (nip part) between a pair of fixing rolls in a fixing device (an example of the fixing unit) 28 such that the toner image is fixed to the recording sheet P, whereby a fixed image is formed.

Examples of the recording sheet P onto which a toner image is to be transferred include plain paper that is used in electrophotographic copying machine, printers, and the like. As a recording medium, an OHP sheet and the like are also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations ends.

Process Cartridge and Toner Cartridge

A process cartridge according to this exemplary embodiment will be described.

The process cartridge according to this exemplary embodiment is provided with a developing unit which contains the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, but descriptions of other parts will be omitted.

Figure 2:
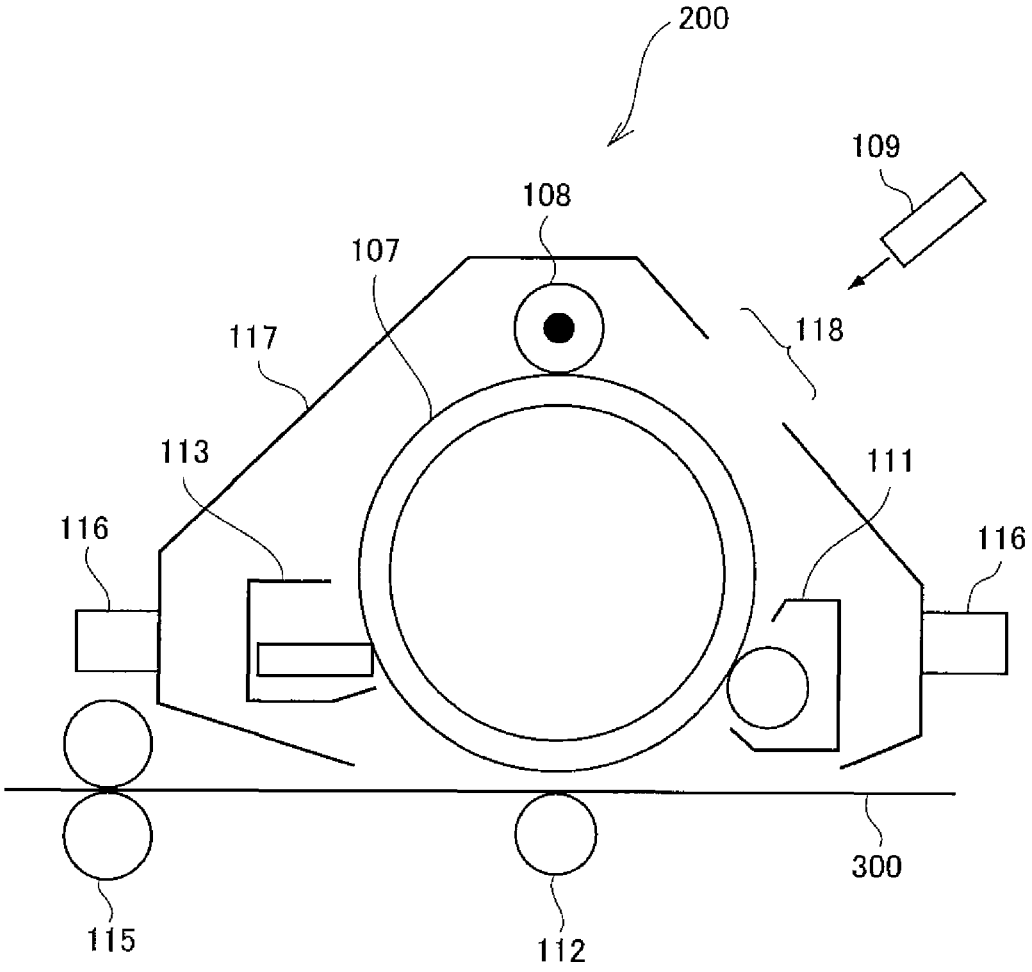
FIG. 2 is a configuration diagram of an example of a process cartridge according to an exemplary embodiment.

FIG. 2 is a configuration diagram of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit) provided around the photoreceptor 107, a developing device 111 (an example of the developing unit), and a photoreceptor cleaning device 113 (an example of the cleaning unit) are integrally combined and held by, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment is a toner cartridge which contains the toner according to this exemplary embodiment and is detachable from an image forming apparatus. The toner cartridge may have a container that contains the toner. The toner cartridge contains a toner for replenishment for being supplied to the developing unit provided in the image forming apparatus.

The image forming apparatus shown in FIG. 1 has a configuration in which the toner cartridges 8Y, 8M, 8C, and 8K are detachable therefrom, and the developing devices 4Y, 4M, 4C, and 4K are connected to the toner cartridges corresponding to the respective developing devices (colors) with toner supply tubes (not shown), respectively. In addition, in a case in which the toner contained in the toner cartridge runs low, the toner cartridge is replaced. The toner cartridge 8Y and the developing device 4Y contain the toner according to this exemplary embodiment.

EXAMPLES

Hereinafter, this exemplary embodiment will be described in more detail using examples and comparative examples, but is not limited to the following examples. Unless specifically noted, "parts", "%", and "ppm" are based on the weight.

Example 1

Preparation of Resin Particle Dispersion (1)

Terephthalic Acid: 30 parts by mole

Fumaric Acid: 70 parts by mole

Ethylene Oxide Adduct of Bisphenol A: 5 parts by mole

Propylene Oxide Adduct of Bisphenol A: 95 parts by mole

A flask having an internal capacity of 5 liters and equipped with a stirrer, a nitrogen-introducing tube, a temperature sensor, and a rectifier is charged with the above materials. The temperature is increased to 220° C. over 1 hour, and 1 part of titanium tetraethoxide is added with respect to 100 parts of the materials. The temperature is increased to 230° C. over 0.5 hours while the produced water is distilled off, and a dehydrative condensation reaction is continued for 1 hour at 230° C. Then, the reactant is cooled. Accordingly, a polyester resin (1) having a weight average molecular weight of 18,000, an acid value of 15 mgKOH/g, and a glass transition temperature of 60° C. is synthesized.

40 parts of ethyl acetate and 25 parts of 2-butanol are added to a container equipped with a temperature adjuster and a nitrogen substitution unit to prepare a mixed solvent, and then 100 parts of the polyester resin (1) is slowly added thereto and dissolved. An aqueous solution of 10% by weight ammonia (corresponding to 3 times the acid value of the resin in terms of molar ratio) is added thereto and stirred for 30 minutes.

Next, the atmosphere in the container is substituted with dry nitrogen, and the temperature is maintained at 40° C. While the mixed liquid is stirred, 400 parts of ion exchange water is dripped at a rate of 2 parts/min to perform emulsification.

After the end of dripping, the emulsion is returned to a room temperature (from 20° C. to 25° C.), and bubbling is performed by dry nitrogen for 48 hours during stirring to reduce the content of the ethyl acetate and 2-butanol to 1,000 ppm or less, thereby obtaining a resin particle dispersion in which resin particles having a volume average particle diameter of 200 nm are dispersed. Ion exchange water is added to the resin particle dispersion to adjust the solid content to 20% by weight, thereby obtaining a resin particle dispersion (1).

Preparation of Colorant Particle Dispersion (1)

Yellow Pigment (C.I. Pigment Yellow 155, manufactured by Clariant, Toner Yellow 3GP) Product Cleaned: 70 parts Anionic Surfactant (manufactured by DKS Co., Ltd., NEOGEN RK): 5 parts Ion Exchange Water: 200 parts The above materials are mixed and dispersed for 10 minutes using a homogenizer (manufactured by IKA, ULTRA-TURRAX T50). Ion exchange water is added such that the solid content in the dispersion is 20% by weight, and thus a colorant particle dispersion (1) in which colorant particles having a volume average particle diameter of 160 nm are dispersed is obtained.

Preparation of Release Agent Particle Dispersion (1)

Paraffin Wax (manufactured by Nippon Seiro Co., Ltd., HNP-9): 100 parts

Anionic Surfactant (manufactured by DKS Co., Ltd., NEOGEN RK): 1 part

Ion Exchange Water: 350 parts

The above materials are mixed, heated at 100° C., and dispersed using a homogenizer (manufactured by IKA, ULTRA-TURRAX T50). Then, the obtained material is subjected to a dispersion treatment using a MANTON GAULIN high-pressure homogenizer (manufactured by Gaulin), and thus a release agent particle dispersion (1) in which release agent particles having a volume average particle diameter of 200 nm are dispersed (solid content: 20% by weight) is obtained.

Preparation of Toner Particles (1)

Resin Particle Dispersion (1): 375 parts

Colorant Particle Dispersion (1): 50 parts

Release Agent Particle Dispersion (1): 50 parts

Dimethyl 2-aminoterephthalate: 0.025 parts

Anionic Surfactant (TAYCAPOWER, manufactured by Tayca): 2 parts

The above materials are put into a round flask made of stainless steel, and a 0.1 N nitric acid is added thereto to adjust the pH to 3.5. Then, 30 parts of a nitric acid aqueous solution having a polyaluminum chloride concentration of 10% by weight is added. Next, the materials are dispersed at 30° C. using a homogenizer (manufactured by IKA, ULTRA-TURRAX T50), and then heated to 45° C. in an oil bath for heating and kept for 30 minutes. After that, 100 parts of the resin particle dispersion (1) is slowly added and kept for 1 hour, and an aqueous solution of 0.1 N sodium hydroxide is added to adjust the pH to 8.5. Then, the obtained material is heated to 85° C. while continuing stirring, and is kept for 5 hours. Then, the obtained material is cooled to 20° C. at a rate of 20° C./min, filtered, sufficiently washed with ion exchange water, and dried. Accordingly, toner particles (1) having a volume average particle diameter of 7.5 μm are obtained.

Preparation of Toner (1)

100 parts of the toner particles (1) and 0.7 parts of dimethyl silicone oil-treated silica particles (manufactured by Nippon Aerosil Co., Ltd., RY200) are mixed using a HENSCHEL mixer to obtain a toner (1). The amount of dimethyl 2-aminoterephthalate in the toner (1), measured through the above-described method, is 250 ppm.

Preparation of Developer (1)

Ferrite Particles (average particle diameter: 50 μm): 100 parts

Toluene: 14 parts

Styrene/Methyl Methacrylate Copolymer (copolymerization ratio: 15/85): 3 parts

Carbon Black: 0.2 parts

The above components except for the ferrite particles are dispersed using a sand mill to prepare a dispersion. This dispersion, as well as the ferrite particles, is put into a vacuum deaeration-type kneader, and stirred and dried under reduced pressure to obtain a carrier.

8 parts of the toner (1) is mixed with 100 parts of the carrier, and thus a developer (1) is obtained.

Example 2

Toner particles are prepared and a developer is obtained in the same manner as in Example 1, except that the amount of dimethyl 2-aminoterephthalate to be added is changed such that the amount thereof in the toner is 1 ppm.

Example 3

Toner particles are prepared and a developer is obtained in the same manner as in Example 1, except that the amount of dimethyl 2-aminoterephthalate to be added is changed such that the amount thereof in the toner is 500 ppm.

Example 4

Toner particles are prepared and a developer is obtained in the same manner as in Example 1, except that as the specific amino compound, 1,4-bis(acetoacetylamino)benzene is used in place of dimethyl 2-aminoterephthalate such that the amount of 1,4-bis(acetoacetylamino)benzene in the toner is changed to 250 ppm.

Example 5

Toner particles are prepared and a developer is obtained in the same manner as in Example 1, except that as the specific amino compound, 1,4-bis(acetoacetylamino)benzene is used in place of dimethyl 2-aminoterephthalate such that the amount of 1,4-bis(acetoacetylamino)benzene in the toner is changed to 1 ppm.

Example 6

Toner particles are prepared and a developer is obtained in the same manner as in Example 1, except that as the specific amino compound, 1,4-bis(acetoacetylamino)benzene is used in place of dimethyl 2-aminoterephthalate such that the amount of 1,4-bis(acetoacetylamino)benzene in the toner is changed to 500 ppm.

Example 7

Toner particles are prepared and a developer is obtained in the same manner as in Example 1, except that as the specific amino compound, 1,4-bis(acetoacetylamino)benzene is used in addition to dimethyl 2-aminoterephthalate such that the amounts of dimethyl 2-aminoterephthalate and 1,4-bis(acetoacetylamino)benzene in the toner are changed to 125 ppm, respectively.

Example 8

Preparation of Toner Particles

Polyester Resin (1): 80 parts

Yellow Pigment manufactured by Sanyo Color Works, Ltd.: C.I. Pigment Yellow 74: 10 parts Paraffin Wax (manufactured by Nippon Seiro Co., Ltd., HNP-9): 10 parts
Dimethyl 2-aminoterephthalate: 0.025 parts The above materials are kneaded by an extruder, and pulverized by a surface pulverization-type pulverizer. Then, classification into fine particles and coarse particles is performed by a wind classifier, and thus, toner particles having a volume average particle diameter of 7.5 μm are obtained.

After that, a toner and a developer are prepared in the same manner as in Example 1.

Example 9

A urea-modified polyester resin is used as the binder resin, and through a dissolution and suspension method (ester elongation polymerization method), toner particles are prepared.

Preparation of Unmodified Polyester Resin (9)
Terephthalic Acid: 1,243 parts
Ethylene Oxide Adduct of Bisphenol A: 1,830 parts
Propylene Oxide Adduct of Bisphenol A: 840 parts The above components are heated and mixed at 180° C., and then 3 parts of dibutyltin oxide is added thereto. The mixture is heated at 220° C. and water is distilled off, whereby a polyester resin is obtained. To the obtained polyester, 1,500 parts of cyclohexanone is added to dissolve the polyester resin, and 250 parts of acetic anhydride is added to this cyclohexanone solution and heated at 130° C. This solution is heated under reduced pressure to remove the solvent and the unreacted acid, and an unmodified polyester resin is obtained. The glass transition temperature Tg of the obtained unmodified polyester resin is 60° C. The acid value thereof is 3 mgKOH/g, and the hydroxyl value thereof is 1 mgKOH/g.

Preparation of Polyester Prepolymer (9)
Terephthalic Acid: 1,243 parts
Ethylene Oxide Adduct of Bisphenol A: 1,830 parts
Propylene Oxide Adduct of Bisphenol A: 840 parts The above components are heated and mixed at 180° C., and then 3 parts of dibutyltin oxide is added thereto. The mixture is heated at 220° C. and water is distilled off, whereby a polyester prepolymer is obtained. 350 parts of the obtained polyester prepolymer, 50 parts of tolylene diisocyanate, and 450 parts of ethyl acetate are put into a container, and this mixture is heated for 3 hours at 130° C. Thus, a polyester prepolymer having an isocyanate group (isocyanate-modified polyester prepolymer (9)) is obtained.

Preparation of Ketimine Compound (9)

50 parts of methyl ethyl ketone and 150 parts of hexamethylene diamine are put into a container and stirred at 60° C., and thus a ketamine compound (9) is obtained.

Preparation of Pigment Dispersant (9)
Yellow Pigment (C.I. Pigment Yellow 155, manufactured by Clariant, Toner Yellow 3GP) Product Cleaned: 100 parts
Ethyl Acetate: 500 parts The above components are mixed, and the mixture is filtered and further mixed with 500 parts of ethyl acetate. After this operation is repeated 5 times, the obtained material is dispersed for about 1 hour using an emulsification disperser CAVITRON (manufactured by Pacific Machinery & Engineering Co., Ltd., CR1010), and thus a pigment dispersion (9) (solid concentration: 10%) in which the pigment (C.I. Pigment Yellow 155) is dispersed is obtained.

Preparation of Release Agent Dispersion (9)
Paraffine Wax (melting temperature: 89° C.): 30 parts
Ethyl Acetate: 270 parts In a state in which the above components are cooled at 10° C., the components are wet-pulverized by a micro bead-type disperser (DCP mill), and thus a release agent dispersion (9) is obtained.

Preparation of Oil Phase Liquid (9)
Unmodified Polyester Resin (9): 136 parts
Pigment Dispersion (9): 500 parts
Ethyl Acetate: 56 parts
Dimethyl 2-aminoterephthalate: 0.042 parts The above components are stirred and mixed, and to the obtained mixture, 75 parts of the release agent dispersion (9) is added and stirred. Thus, an oil phase liquid (9) is obtained.

Preparation of Styrene-Acrylic Resin Particle Dispersion (9)
Styrene: 370 parts
n-Butyl Acrylate: 30 parts
Acrylic Acid: 4 parts
Dodecanethiol: 24 parts
Carbon Tetrabromide: 4 parts A mixture obtained by mixing and dissolving the above components is dispersed and emulsified in an aqueous solution obtained by dissolving 6 parts of a nonionic surfactant (manufactured by Sanyo Chemical Industries, Ltd.: NONIPOL 400) and 10 parts of an anionic surfactant (manufactured by DKS Co., Ltd.: NEOGEN SC) in 560 parts of ion exchange water in a flask. Then, while the components are mixed for 10 minutes, an aqueous solution obtained by dissolving 4 parts of ammonium persulfate in 50 parts of ion exchange water is added thereto and nitrogen substitution is performed. Then, while being stirred, the content in the flask is heated in an oil bath until its temperature is increased to 70° C., and emulsion polymerization is continued for 5 hours. In this manner, a styrene-acrylic resin particle dispersion (9) (resin particle concentration: 40% by weight) in which resin particles having an average particle diameter of 180 nm and a weight average molecular weight (Mw) of 15,500 are dispersed is obtained. The glass transition temperature of the styrene-acrylic resin particles is 59° C.

Preparation of Aqueous Phase Liquid (9)
Styrene-Acrylic Resin Particle Dispersion (9): 60 parts
Aqueous Solution of 2% SEROGEN BS-H (manufactured by DKS Co., Ltd.): 200 parts
Ion Exchange Water: 200 parts The above components are stirred and mixed to obtain an aqueous phase liquid (9).

Preparation of Toner Particles
Oil Phase Liquid (9): 300 parts
Isocyanate-Modified Polyester Prepolymer (9): 25 parts
Ketimine Compound (9): 0.5 parts The above components are put into a container and stirred for 2 minutes using a homogenizer (ULTRA-TURRAX: manufactured by IKA) to obtain an oil phase liquid (1P). Then, 1,000 parts of the oil phase liquid (9) is added to the container and stirred for 20 minutes using the homogenizer. Next, this mixture is stirred using a propeller-type stirrer for 48 hours under ordinary pressure (1 atm) at room temperature (25° C.), and the isocyanate-modified polyester prepolymer (9) and the ketimine compound (9) are reacted to prepare a urea-modified polyester resin, and the organic solvent is removed to form a granular material. Next, the granular material is water-washed, dried, and classified, and thus toner particles (9) are obtained. The volume average particle diameter of the toner particles is 12 μm.

Preparation of Toner (9)

100 parts of the toner particles (9), 1.5 parts of hydrophobic silica (manufactured by Nippon Aerosil Co., Ltd., RY50), and 1.0 part of hydrophobic titanium oxide (manufactured by Nippon Aerosil Co., Ltd., T805) are mixed for 3 minutes at a peripheral speed of 30 m/s using a HENSCHEL mixer. Then, a toner (9) is obtained through sieving with a vibration sieve having openings of 45 μm.

Comparative Example 1

Toner particles are prepared and a developer is obtained in the same manner as in Example 1, except that dimethyl 2-aminoterephthalate is not added.

Comparative Example 2

Toner particles are prepared and a developer is obtained in the same manner as in Example 1, except that as a colorant, C.I. Pigment Yellow 74 is used in place of C.I. Pigment Yellow 155.

Comparative Example 3

Toner particles are prepared and a developer is obtained in the same manner as in Example 1, except that the amount of dimethyl 2-aminoterephthalate to be added is changed such that the amount thereof in the toner particles is 0.8 ppm.

Comparative Example 4

Toner particles are prepared and a developer is obtained in the same manner as in Example 1, except that the amount of dimethyl 2-aminoterephthalate to be added is changed such that the amount thereof in the toner particles is 550 ppm.

Comparative Example 5

Toner particles are prepared and a developer is obtained in the same manner as in Example 1, except that 1,4-bis(acetoacetylamino)benzene is used in place of dimethyl 2-aminoterephthalate, and the amount of 1,4-bis(acetoacetylamino)benzene to be added is changed such that the amount thereof in the toner particles is 0.8 ppm.

Comparative Example 6

Toner particles are prepared and a developer is obtained in the same manner as in Example 1, except that 1,4-bis(acetoacetylamino)benzene is used in place of dimethyl 2-aminoterephthalate, and the amount of 1,4-bis(acetoacetylamino)benzene to be added is changed such that the amount thereof in the toner particles is 550 ppm.

Evaluations

The following evaluations are performed using the developers obtained in the examples. The results thereof are shown in Table 1.

Evaluation of Image Bending Strength and Density

The following operations and image formation are performed under an environment in which the temperature is 25° C. and the humidity is 60%.

APEOSPORT IV C4470 manufactured by Fuji Xerox Co., Ltd. is prepared as an image forming apparatus which forms an image for evaluation. A developer is put into a developing unit, and a replenishment toner (the same toner as the toner contained in the developer) is put into a toner cartridge. Next, on coated paper (JD COAT, manufactured by Fuji Xerox Co., Ltd., product name: JD Coat 127, basis weight: 127 g/m$^2$, thickness: 140 μm), a yellow solid image of 5 cm×5 cm having an image area ratio of 100% and a yellow halftone image of 5 cm×5 cm having an image area ratio of 50% are formed on 100 pieces of paper while performing continuous output. The obtained 100-th image is subjected to the following evaluations.

Evaluation of Image Bending Strength

The obtained 100-th halftone image of 5 cm×5 cm having an image area ratio of 50% is subjected to the image bending strength evaluation. The paper on which the image is formed is folded one time, and then opened. The folded image part is wiped with cotton, and a width of the image deleted (μm) is measured. A white part (part of an image deleted) having a width of 40 μm or less is in an allowed level.

Density

The obtained 100-th solid image of 5 cm×5 cm having an image area ratio of 100% is subjected to the density evaluation. The yellow image density is measured using a reflection spectral densitometer (manufactured by X-Rite Inc., product name: XRITE-939). A density of 1.4 or higher is in an allowed level.

Evaluation of Transfer Properties

The following operations and image formation are performed under an environment in which the temperature is 30° C. and the humidity is 80%.

APEOSPORT IV C4470 manufactured by Fuji Xerox Co., Ltd. is prepared as an image forming apparatus which forms an image for evaluation. A developer is put into a developing unit, and a replenishment toner (the same toner as the toner contained in the developer) is put into a toner cartridge. Next, on high-quality paper (P-paper, manufactured by Fuji Xerox Co., Ltd., product name: P, basis weight: 64 g/m$^2$, thickness: 88 μm), a yellow solid image of 5 cm×5 cm having an image area ratio of 100% is formed on 100 pieces of paper while performing continuous output. An adhesive tape is adhered to the image remaining on the photoreceptor after the 100-th transfer, and then peeled therefrom to transfer the image onto the adhesive tape, and the following evaluation is performed.

The image transferred onto the adhesive tape is subjected to the density evaluation. The density of the yellow image remaining after the transfer is measured using a reflection spectral densitometer (manufactured by X-Rite Inc., product name: XRITE-939). A density of 0.10 or lower is in an allowed level.

Evaluation of Pigment Dispersibility

Light transmittance PE of the image is evaluated using dispersibility of the pigment in the image (amount of aggregates of the pigment) as an index.

Specifically, regarding the (100-th) solid image of 5 cm×5 cm having an image area ratio of 100% and formed in the density evaluation, a ratio between the total transmitted light component and the straight light component of each wavelength in a visible light range is calculated using the following formula.

$$PE=\log(\Sigma[P(\lambda)+N(\lambda)]/n)/\log(\Sigma[P(\lambda)]/n)$$ (here, $P(\lambda)$ is a straight light component, and $N(\lambda)$ is a diffused light component.)

For the measurement of the total transmitted light component and the straight light component of each wavelength in a visible light range, a MATCH SCAN manufactured by Diano Corporation is used.

The colorants and the additives in the toners and the evaluation results in the examples are shown in the following Table 1.

TABLE 1

| | Colorant | | Additive | | Evaluation Results | | | |
|---|---|---|---|---|---|---|---|---|
| | | | | | Image | | | |
| | Pigment | Amount (% by weight) | Dimethyl 2-aminoterephthalate | 1,4-Bis (acetoacetylamino) benzene | Bending Strength (μm) | Image Density | Transfer Properties | PE Value |
| Example 1 | PY155 | 10 | 250 ppm | 0 ppm | 15 | 1.75 | 0.05 | 74 |
| Example 2 | PY155 | 10 | 1 ppm | 0 ppm | 35 | 1.41 | 0.05 | 65 |
| Example 3 | PY155 | 10 | 500 ppm | 0 ppm | 30 | 1.55 | 0.07 | 68 |
| Example 4 | PY155 | 10 | 0 ppm | 250 ppm | 20 | 1.72 | 0.06 | 75 |
| Example 5 | PY155 | 10 | 0 ppm | 1 ppm | 30 | 1.42 | 0.05 | 68 |
| Example 6 | PY155 | 10 | 0 ppm | 500 ppm | 35 | 1.58 | 0.08 | 64 |
| Example 7 | PY155 | 10 | 125 ppm | 125 ppm | 20 | 1.60 | 0.06 | 70 |
| Example 8 | PY155 | 10 | 250 ppm | 0 ppm | 15 | 1.68 | 0.06 | 72 |
| Example 9 | PY155 | 10 | 250 ppm | 0 ppm | 10 | 1.71 | 0.07 | 73 |
| Comparative Example 1 | PY155 | 10 | 0 ppm | 0 ppm | 60 | 1.21 | 0.06 | 50 |
| Comparative Example 2 | PY74 | 10 | 250 ppm | 0 ppm | 55 | 1.35 | 0.07 | 52 |
| Comparative Example 3 | PY155 | 10 | 0.8 ppm | 0 ppm | 45 | 1.30 | 0.07 | 60 |
| Comparative Example 4 | PY155 | 10 | 550 ppm | 0 ppm | 35 | 1.36 | 0.2 | 65 |
| Comparative Example 5 | PY155 | 10 | 0 ppm | 0.8 ppm | 45 | 1.28 | 0.06 | 62 |
| Comparative Example 6 | PY155 | 10 | 0 ppm | 550 ppm | 35 | 1.38 | 0.2 | 63 |

In the above Table 1, "PY155" indicates C.I. Pigment Yellow 155, and "PY74" indicates C.I. Pigment Yellow 74.

It is found that in the examples using a toner which contains C.I. Pigment Yellow 155 and a specific amino compound, that is, at least one selected from dimethyl 2-aminoterephthalate and 1,4-bis(acetoacetylamino)benzene and in which the total content of the specific amino compound is from 1 ppm to 500 ppm, the image density is high and the image bending strength is high in comparison to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a binder resin;

C.I. Pigment Yellow 155; and at least one compound selected from dimethyl 2-aminoterephthalate and 1,4-bis(acetoacetylamino)benzene, wherein a total content of dimethyl 2-aminoterephthalate and 1,4-bis(acetoacetylamino)benzene in the toner is from 100 ppm to 500 ppm.

2. The electrostatic charge image developing toner according to claim 1, wherein the total content of dimethyl 2-aminoterephthalate and 1,4-bis(acetoacetylamino)benzene in the toner is from 100 ppm to 400 ppm.

3. The electrostatic charge image developing toner according to claim 1, wherein the binder resin includes a polyester resin.

4. The electrostatic charge image developing toner according to claim 3, wherein the polyester resin has a glass transition temperature of from 50° C. to 65° C.

5. The electrostatic charge image developing toner according to claim 1, wherein the binder resin includes a urea-modified polyester resin.

6. The electrostatic charge image developing toner according to claim 5, wherein the urea-modified polyester resin has a glass transition temperature (Tg) of from 45° C. to 60° C.

7. An electrostatic charge image developer comprising:

the electrostatic charge image developing toner according to claim 1 and a carrier.

8. A toner cartridge comprising:

a container that contains the electrostatic charge image developing toner according to claim 1, wherein the toner cartridge is detachable from an image forming apparatus.

9. The electrostatic charge image developing toner according to claim 1, wherein the at least one compound is incorporated into the toner separate from the C.I. Pigment Yellow 155.

* * * * *